United States Patent [19]

Karr

[11] 4,444,362

[45] Apr. 24, 1984

[54] APPARATUS AND METHOD FOR STARTING SUCCESSIVE LEADING ENDS ON TRAVELLING WEB IN A WINDER

[75] Inventor: Gerald W. Karr, South Beloit, Ill.

[73] Assignee: Beloit Corporation, Beloit, Wis.

[21] Appl. No.: 355,234

[22] Filed: Mar. 5, 1982

[51] Int. Cl.[3] ..... B65H 35/04

[52] U.S. Cl. ..... 242/56.6; 83/408

[58] Field of Search ..... 242/56 R, 56 A, 56 B, 242/56.6; 156/510, 512, 525; 83/407, 408, 302, 428, 919, 433

[56] References Cited

U.S. PATENT DOCUMENTS 2,176,198 10/1939 Berry ..... 242/65
3,586,253 6/1971 Gilbank ..... 242/65
3,756,527 9/1973 Collins et al. ..... 242/56.2
3,857,524 12/1974 Melead et al. ..... 242/56

*Primary Examiner*—Leonard D. Christian
*Attorney, Agent, or Firm*—Hill, Van Santen, Steadman & Simpson

[57] ABSTRACT

Apparatus and method for starting respective leading ends on web running continuously and would into successive rolls, such as paper. As each roll reaches a final diameter, a fresh leading end is provided on the web by slitting in a generally cross-machine direction from a leading starter tongue projection extending downstream. The starter tongue projection with the fresh leading end of the web is directed into winding relation onto a fresh rotary core for winding of the web into another roll. This is adapted to be effected automatically and without interruption of high speed web travel and successive roll starting and winding.

20 Claims, 11 Drawing Figures

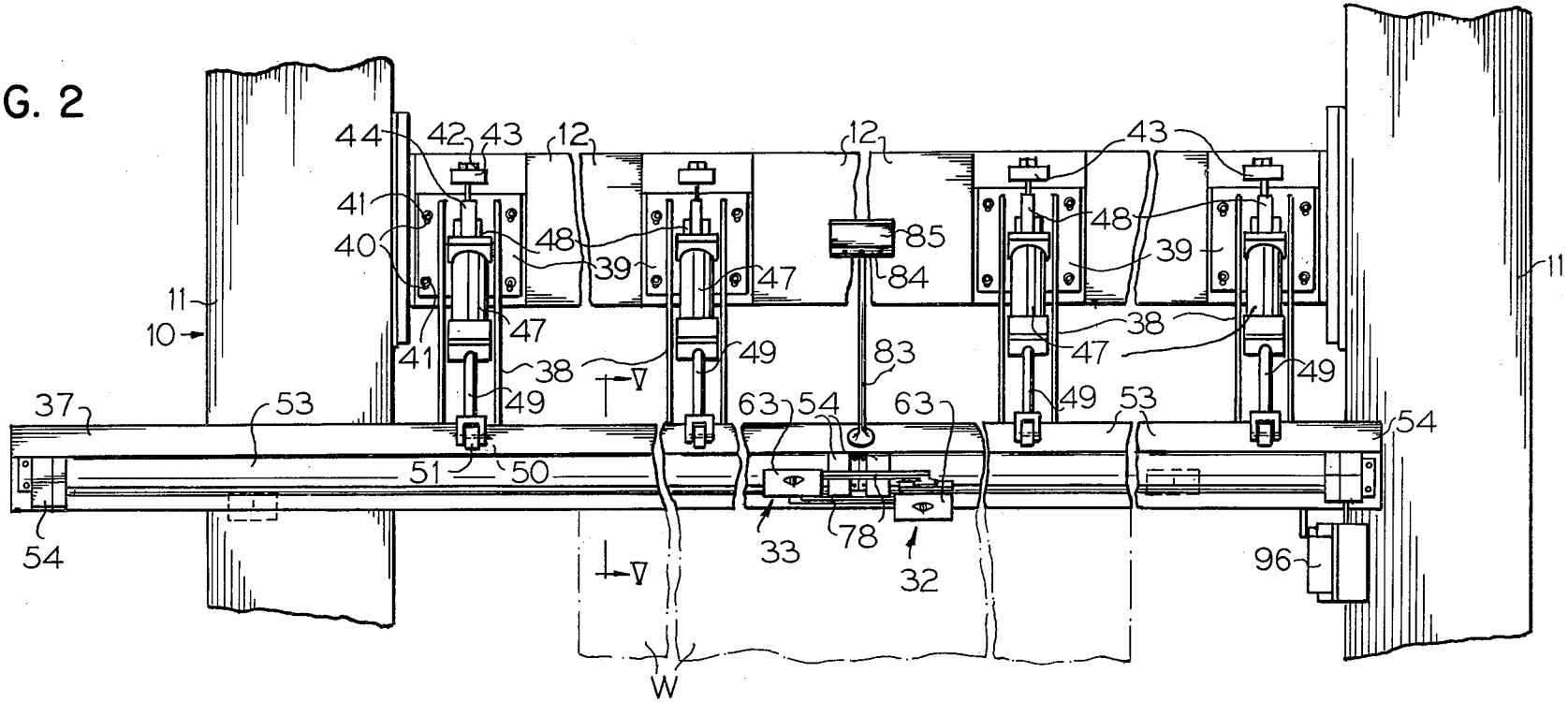
FIG. 2
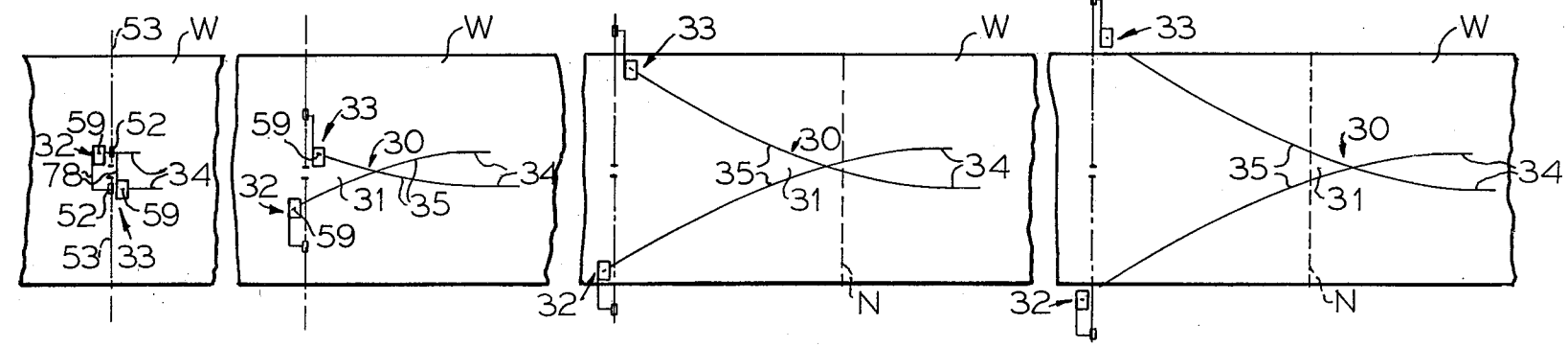
FIG. 3a
FIG. 3b
FIG. 3c
FIG. 3d

PRESSURE SOURCE
CONTROLLER
103
20
92
90
22
27
19
88
104
105
107
17
14
30
W
29
28
R
93
47
37
102
98
45
53
97
95
94
55
32
101
100
84
83
99
33
85
94
98
97
47
53
45
91
47
102
96
89
87

APPARATUS AND METHOD FOR STARTING SUCCESSIVE LEADING ENDS ON TRAVELLING WEB IN A WINDER

This invention relates to starting successive leading ends on travelling web in a winder, and is more particularly concerned with facilitating for each roll to be wound in a winder, the starting of winding of a respective leading end of the web onto a rotating core which may be in driving nip engagement with a rotary winding drum functioning to continue winding of the web to a desired diameter on the core. The system to be described is especially useful in winding freshly manufactured paper.

Various expedients have heretofore been employed for starting or turning up a leading end of a continuously running web onto a shaft, reel, spool or (more generically) core driven rotatably by engagement with a winding drum functioning to continue winding of the web onto the core until a roll of desired diameter has been achieved.

Fairly sophisticated winders have been developed for this purpose. By way of example, prior U.S. Pat. No. 2,176,198 is referred to as an early version of such winders and such patent suggests that after a roll of paper web has been fully wound, the web is severed by a conventional air slice and directed around a new core.

U.S. Pat. No. 3,586,253 shows a later development and is particularly referred to for its showing of a supplying successive empty, fresh cores to a winder drum of the winder apparatus.

U.S. Pat. No. 3,857,524 discloses a particular arrangement of combination cut-off knife and guide for initiating winding of a freshly severed leading end of the web onto a fresh core after a preceeding roll of the web has been fully wound. In this patent, the web is severed entirely across the web by the cut-off knife which extends transversely across the width of the web and is forcibly driven against the tensioned web with a rapid chopping action. A disadvantage of this arrangement is that the combination cut-off and guiding device is necessarily located between the winding drum and an enveloper roll which is required to continue surface winding operation of the filled or fully wound roll after it is shifted away from the winding drum, and the cut-off and guiding device goes into action against the span of the web between the winding roll and the enveloper roll. A long and expensive knife blade is required. Resharpening presents problems.

In another conventional system, a limited length transverse slash has been made in the advancing web upstream from the nip between a fresh core supplied to the winding drum, and then on the downstream side of the nip an air jet directed toward the nip enters the slit and initiates tearing of the web away from the slit thus initiating a fresh leading end which is blown against the rotating core and tears away from the trailing portion of the web finally wound onto the fully wound preceeding roll. This system has been employed with considerable success with lighter grades of paper web, but is impractical for heavier grades of web or sheet due to the higher longitudinal or machine direction strength of the heavier grade webs. Further, in recent years the width of paper webs has increased for economy reasons, and especially in the wider groundwood sheet machines an increasing number of missed turn-ups have been experienced with the slasher and turn-up guide system, principally because the tear often does not progress all the way to the edge of the web.

A principal object of the present invention is to overcome the disadvantages, drawbacks, inefficiencies, shortcomings, and problems inherent in prior expedients for effecting and starting winding of fresh leading ends on continuously running webs in roll winders.

To this end the present invention provides in apparatus for winding web running continuously in a machine direction into successive rolls, and including means for starting winding of a respective leading end of the web onto a respective fresh rotating core for each roll: slitting means located upstream from said fresh rotating core; means for operating said slitting means, after a preceeding roll has been wound to a desired diameter, for starting a fresh leading end on the continuously running web by slitting the web in a generally cross machine direction from a leading starter tongue projection extending downstream, and for thereby separating the fresh leading end from the length of web wound on said preceeding roll; and said winding starting means being adapted for directing said starter tongue projection with said fresh leading end into winding relation onto the fresh rotating core for winding of the web into another roll.

This invention also provides a method of winding into successive rolls a web running continuously in a machine direction, and including, for each roll, starting winding of a respective leading end of the web onto a respective fresh rotating core, comprising: at a location upstream from the fresh rotating core, and after a preceeding roll has reached a desired diameter, starting a fresh leading end on the web by slitting the continuously running web in a generally cross machine direction from a leading starter tongue projection extending downstream, and thereby effecting the fresh leading end from the length of web wound on said preceeding roll; and then directing said starter tongue projection with said fresh leading end of the web into winding relation onto the fresh rotating core for winding of the web into another roll.

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure and in which:

FIG. 2 is a fragmental elevational view taken substantially in the plane of line II—II of FIG. 1;

Figure 1:
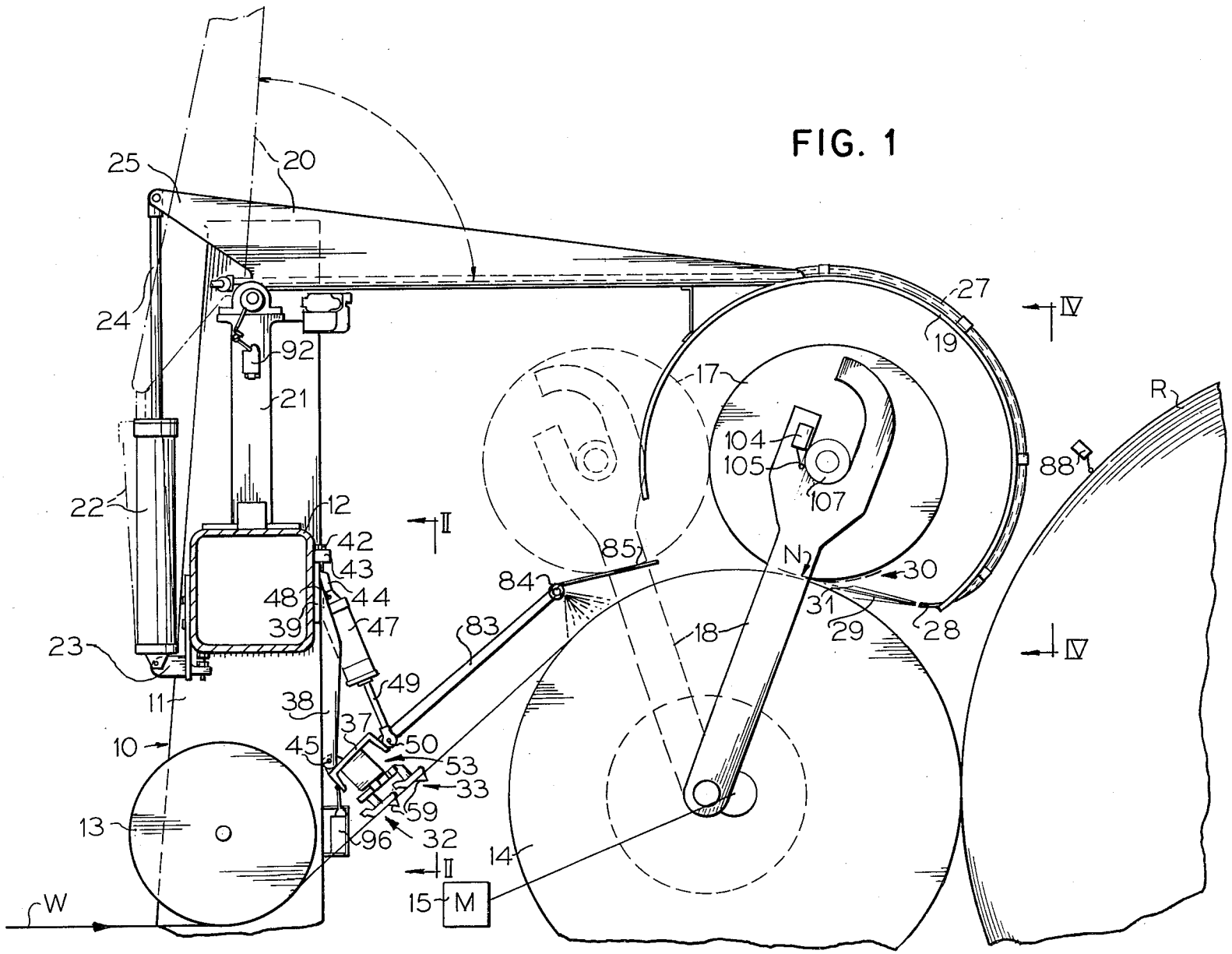
FIG. 1 is a more or less schematic side elevational sectional view showing apparatus embodying the invention.
Figure 4:
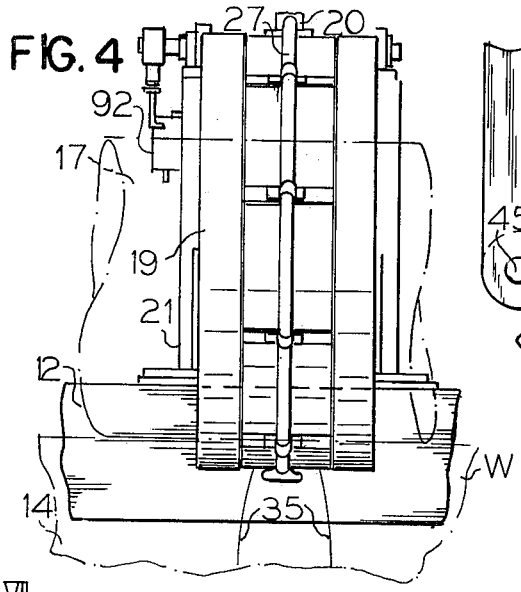
Figure 5:
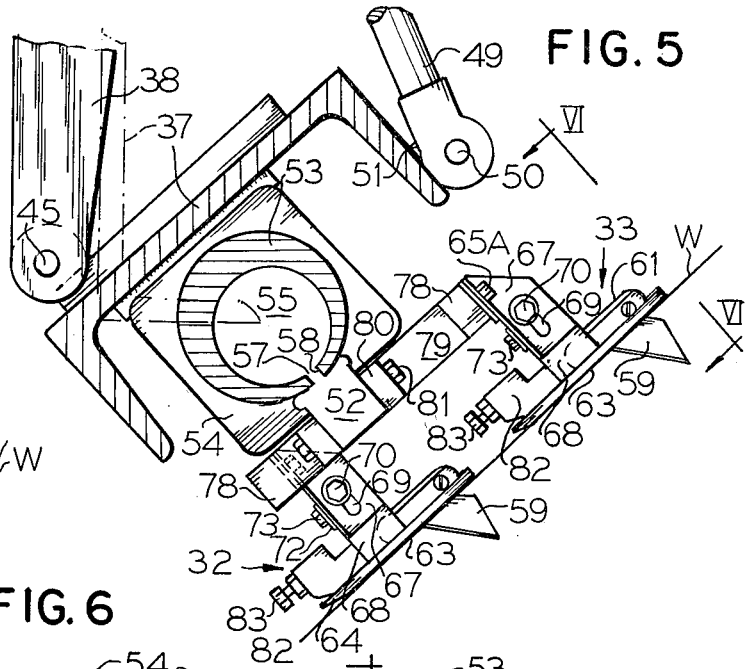
Figure 6:
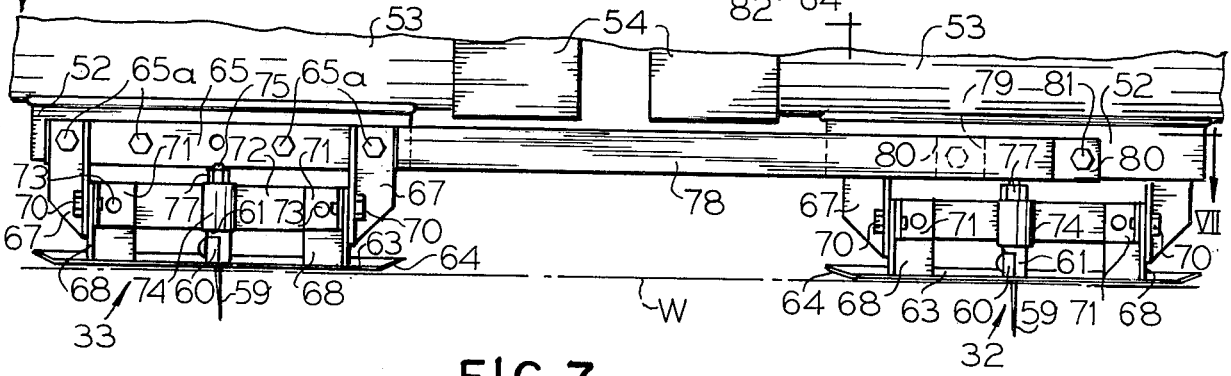
Figure 7:
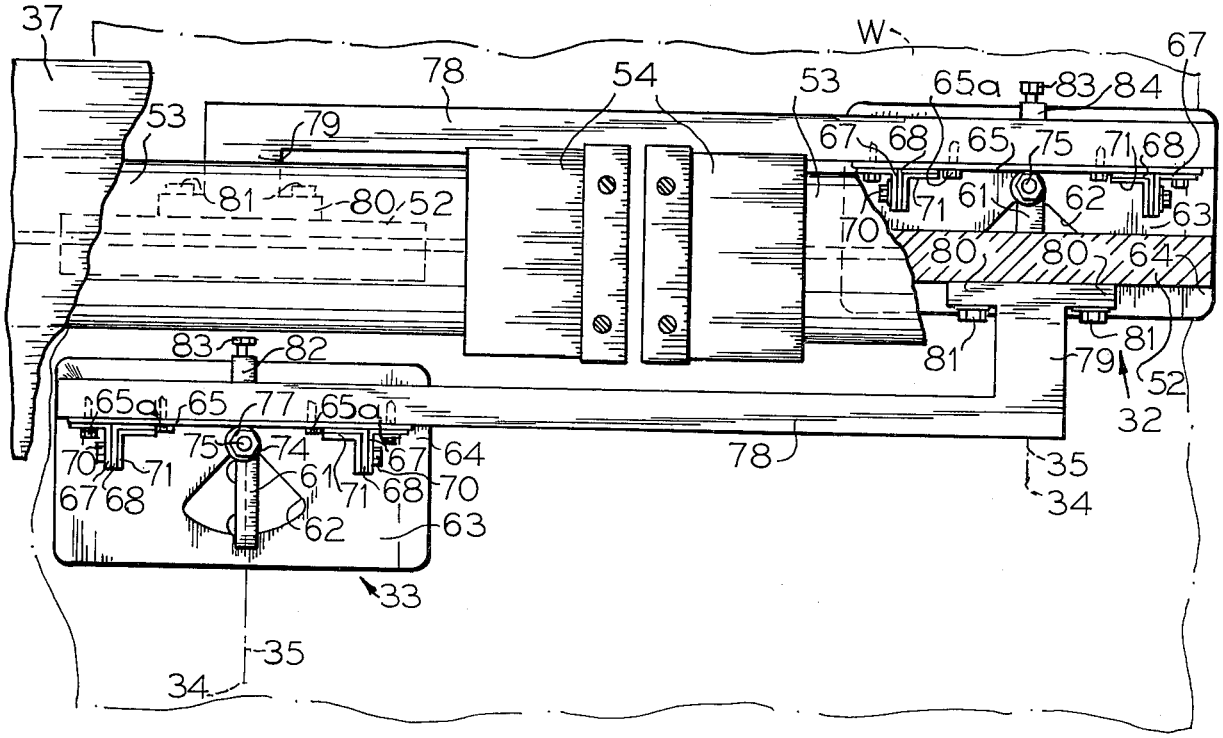
Figure 8:
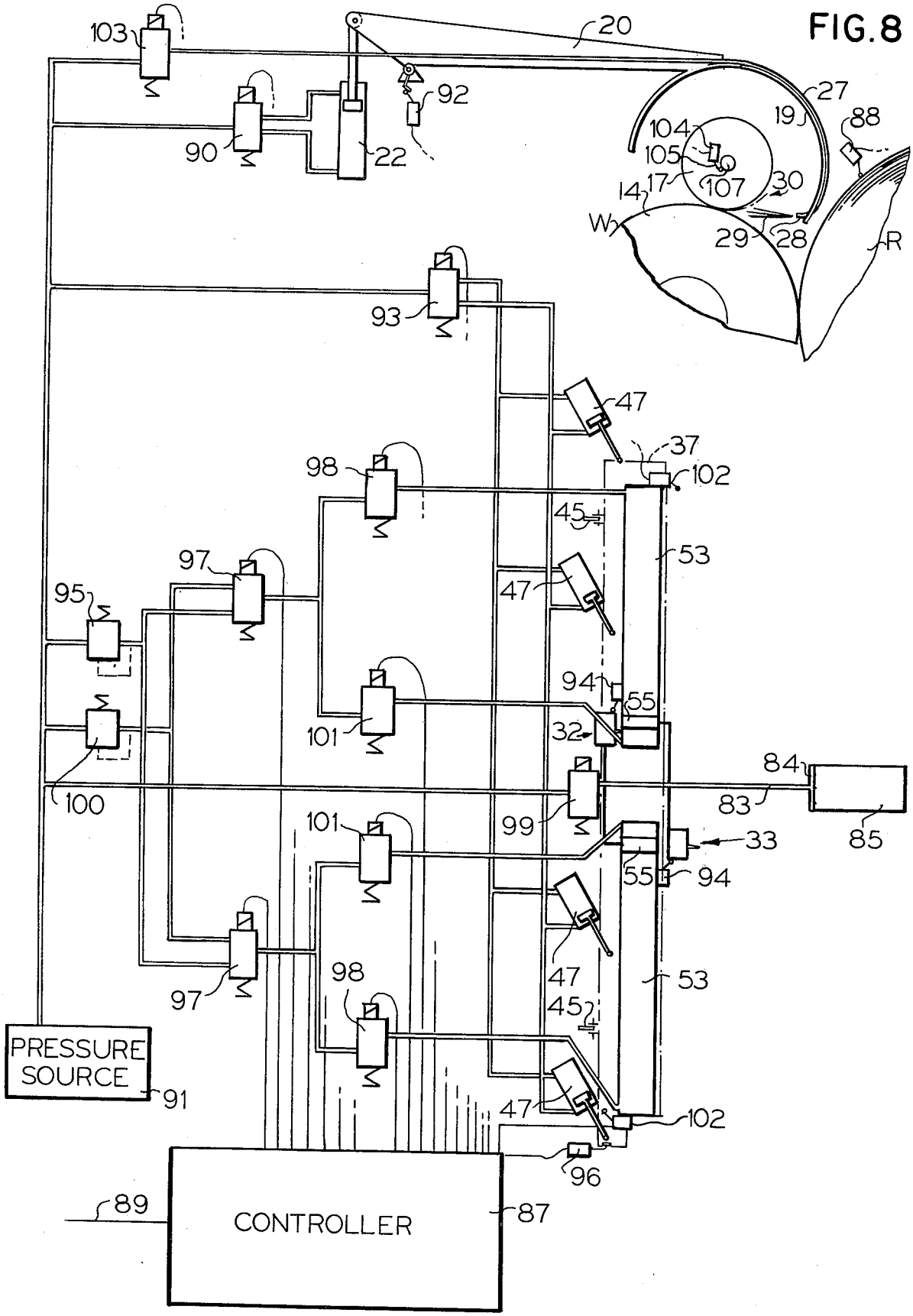

FIGS. *3a* to *3d* are fragmentary schematic plan views showing the sequence of steps involved in the method of the present invention as practiced by the disclosed apparatus;

FIG. 4 is a fragmentary elevational view taken substantially in the plane of line IV—IV of FIG. 1;

FIG. 5 is an enlarged fragmentary sectional elevational view taken substantially along the line V—V of FIG. 2;

FIG. 6 is a fragmentary elevational view taken substantially in the plane of line VI—VI of FIG. 5;

FIG. 7 is a fragmentary plan view taken substantially along the line VII—VII of FIG. 6; and FIG. 8 is a schematic electro-pneumatic operating diagram.

A winder apparatus embodying the present invention, as shown in FIGS. 1 and 2, includes a machine frame 10 comprising spaced uprights 11 supporting therebetween a horizontal beam 12. A web W to be wound, and which may be paper up to 400 inches wide is adapted to travel continuously at high speed which may attain up to 4000 feet per minute between the uprights 11 on a guide roll 13 supported by the machine frame, and then over a winding drum 14 carried rotatably in a suitable manner (not shown) by the machine frame 10 and driven at machine speed as by means of a motor 15. From the winding drum 14, the web W passes into a roll R driven by engagement with the drum 14. The manner in which the roll R is supported and handled may be in accordance with the disclosures in the aforesaid U.S. Pat. Nos. 3,586,253 and 3,857,524 which are to any extent necessary for full understanding incorporated herein by reference. It will be understood that the roll R will be rolled on a reel or core 17. As more particularly disclosed in U.S. Pat. No. 3,586,253, a succession of the cores 17 is adapted to be supplied for winding a succession of the rolls R.

The present invention is directed more particularly to the separation of successive lengths of the continuously running web W from preceeding lengths that have already been wound into successive rolls R, and starting the succeeding lengths onto successive reel cores 17 for winding into rolls.

Each successive reel core 17 is delivered to a transfer arm device 18 which swings each successive fresh core 17 from the delivery device (not shown) into driving running relation to the perimeter of the drum 14. As the reel or spool 17 reaches nipping relation to the drum 14, a generally semi-circular web leading end guide member 19 (FIGS. 1 and 4) is lowered into concentric spaced relation to the rotating core. For this purpose, the guide member 19 is carried by the distal end portion of a supporting arm 20 which is pivotally mounted on a bracket 21 supported by the beam 12. Means for actuating the arm 20 swingably comprises a pneumatic cylinder 22 having its proximal end pivotally mounted to a bracket 23 on the beam 12 and having a piston rod 24 pivotally attached to a proximal terminal level extension 25 on the arm 20. Through this arrangement, the arm 20 is adapted to be swung between the full line and dotted line positions shown in FIG. 1 for moving the arcuate guide member 19 into and out of position relative to the core 17 freshly positioned for winding of the web W thereon.

Carried by the guide member 19 is an air pipe 27 which has a nozzle 28 directed toward the offrunning side of the nip between the drum 14 and the core 17. An air jet directed from the nozzle 28 is adapted to turn up and direct a leading end 30 on the continuously running web W onto the core 17 for starting winding of the web onto the core which at this time will have reached a speed of rotation equal to the speed of rotation of the drum 14 and the speed of travel of the web W. Although at the start the leading end 30 may be the starting terminal end of the web W as it comes from processing apparatus upstream from the winder, after the initial roll R has been rolled to a desired diameter fresh leading ends 30 will be formed on the continuously running web W.

Forming of fresh leading ends 30 is started at a suitable location upstream from the fresh rotating core 17 after each preceeding roll R has reached the desired diameter, by slitting the web W in such a manner as to attain a leading end tongue area 31, sometimes referred to as a turn-up tail, separated from the continuously running web. Although the tongue area 31 may commence at one edge of the web, best results are attained by locating the tongue area on the longitudinal center line of the web. Slitting of the tongue area 31 is desirably effected by slitting means which for location of the tongue area on the longitudinal center of the web comprises a pair of coordinated slitting devices 32 and 33 (FIGS. *3a–3d*). In the arrangement shown, the slitting devices 32 and 33 are coordinated in operation to start slitting of the web at respective spaced starting points 34 at opposite sides of the longitudinal center line of the running web. Then after a short machine direction slitting start, slitting continues along slit lines 35 in generally cross-machine direction toward the respective opposite edges of the running web. The rate of travel of the slitting devices 32 and 33 in respective opposite cross-machine directions is so related to the speed of forward travel of the web W, which may be on the order of 4000 feet per minute, that the length of the tongue area 31 will be sufficient so that the leading end of the tongue area 31 will reach and enter between and be gripped by nip N between the winding drum 14 and the fresh rotating core 17 before the slits 35 run out at the respective opposite edges of the web W. Thereby the portion of the web upstream from the slitting zone remains effectively attached to the downstream portion of the web for uninterrupted forward running of the web W both upstream and downstream from the fresh leading end 30. Then, after passing through the nip N, the tongue area 31 is turned up for winding onto the fresh core 17 by action of the jet 29 which thus starts winding of the entire leading end 30 onto the core and continues the uninterrupted travel of the web as winding thereof onto the fresh core proceeds. The detached downstream portion of the web runs onto the preceeding finished roll R. It may be noted that conveniently, the slits 35 extend generally diagonally and divergently toward the respective opposite edges of the web W.

Conveniently, the slitting devices 32 and 33 are operatively supported by an elongate beam 37 which extends in cross-machine direction upstream from the fresh rotating core 17 in overlying relation to the span of the web W running between the rotating guide roller 13 and the winding roll 14. Mounting of the beam 37 is conveniently effected by means of a plurality of suspension brackets 38 attached to and depending from the frame cross beam 12. Each of the brackets 38 has fixed on its upper endh portion a vertical mounting plate 39 provided with vertically elongate bolt holes 40 through which attachment bolts 41 extend for securing the mounting plate to the face of the beam 12 which is directed generally toward the winding drum 14. The elongate bolt holes 40 permit accurate vertical adjustment of the brackets 38 and thereby the beam 37 as by means of respective vertically extending adjustment screws 42, the shanks of which extend freely through respective fixed bosses 43 on the frame beam 12. At their lower ends, the screws 42 are threaded into respective underlying ear lugs 44 rigid with the respective mounting plates 39. Thus, by turning the respective heads of the adjustment screws 42, which lie in thrust bearing relation on the bosses 43, vertually micrometer precision vertical adjustment of the brackets 39 is permitted.

Attachment of the lower ends of the brackets 38 to the beam 37 is by means of respective pivots 45 (FIGS.

1 and 5), in such manner that the beam 37 can be swung up, i.e. raised, from its edge nearest the brackets 38 into a position substantially backed up against the brackets, as best visualized on comparison of the full line position in FIG. 5 which shows the lowered position of the beam 37 for slitting operation of the slitting devices 32 and 33, and the dot dash fantom position where the beam 37 and the slitting devices are raised to inactive position. Raising and lowering of the beam 37 is adapted to be accomplished by means of respective pneumatic cylinders associated with the brackets 38, and each of which has a proximal end connected by pivot means 48 (FIGS. 1 and 2) to the ear lug 44 of the bracket 38 while piston rod 49 of the cylinder is connected distally by means of a pivot 50 to a respective eye lug 51 fixed on the side of the beam 37 remote from the side adjacent to which the beam is connected to the brackets 38.

Operational mounting of the slitting devices 32 and 33 is effected by means carried by the beam 37 along which the slitting devices are adapted to be actuated longitudinally from a starting position as shown in full outline in FIGS. 2, *3a*, 6 and 7, laterally in opposite machine directions while cutting the slits 35 and ending in clearance relation to the sides of the web W as indicated in dash outline in FIG. 2 and FIG. *3d*. To this end, each of the slitting devices 32 and 33 may comprise an assembly mounted to means such as an elongated head bar 52 (FIGS. 5–7) by which each of the slitting devices is adapted through means of a suitable actuator 53 to be not only supported by the beam 37 but also to be actuated longitudinally therealong in the operation of the slitting devices. While the actuators 53 may comprise any preferred expedient such as a motor driven chain or cable, a convenient device for the purpose comprises respective air cylinder means preferably of the Origa rodless type, therebeing a separate respective one of the actuators 53 for each of the slitting devices 32 and 33. Each of the actuators 53 has at each opposite end thereof an end closure 54 which is fixedly attached in any desirable manner to the underside of the beam 37. Within each of the cylinders of the actuators 53, a free-floating piston 55 (FIGS. 5 and 8) is connected to the respective head bar 52 by means of a relatively narrow connecting fin 57 extending through a narrow guide slot 58 in the wall of the actuator cylinder.

In a preferred construction, each of the slitting devices 32 and 33 comprises a respective razor-type slitting blade 59 (FIGS. 1–5 & 6) readily replacably secured as by means of a clamping plate 60 in a holder 61 in a manner to project through a clearance aperture 62 (FIG. 7) in a web-facing stabilizer shoe plate 63 which is desirably elongate in cross-machine direction and has its upstream and side margins turned up as at 64 for smooth sliding engagement with the running web W. For mounting the blade holder 61 and the shoe 63 to the respective head bar 52, bracket means comprising a head bar strip 65 is secured by means of cap screws 65*a* to the head bar 52. Downwardly projecting side angle leg members 67 at the opposite ends of the head strip 65 are attached in back-to-back assembly with upstanding respective angular posts 68 carried fixedly by the respective shoe 63. Attachment of the leg members 67 to the posts 68 is effected in a manner to permit up and down adjustment of the shoe 63 relative to the associated head bar 52 for optimum performance of the slitter device. For this purpose, the legs 67 are provided with longitudinally extending bolt holes 69 through which the shanks of respective attachment cap screws 70 are projectable to extend through round bolt holes of the contiguous flanges of the posts 68 with the screw being retainingly threaded into a tapped nut angle 71.

Means for mounting the blade holder 61 in each instance comprise a crossbar 72 attached as by means of cap screws 73 to the posts 68. Shanks of the screws 73 extend through end portions of the bar 72 and through the contiguous flanges of the respective posts 68 and are threadedly engaged in a respective flange of the adjacent angular nut 71. Fixed to the forward side of the crossbar 72 is a swivel busing 74 aligned with the clearance aperture 62 and accomodating a swivel pin 75 fixed on the holder 61. The pin 75 is adapted to be inserted through the bushing 74 from below and is threaded on its upper end portion which projects above the bushing and carries a retaining nut 77, there being suitable thrust washers mounted about the pin 75 at the upper and lower ends of the bushing 74.

To enable the slitting devices 32 and 33 to start slitting the web W at the points 34 at respectively opposite sides of the center line of the travelling web W and then to move past one another while crossing the slits 35 at the point of the tongue area 31 (FIG. *3d*), the devices 32 and 33 are mounted in offset relation to one another by means herein comprising respective rigid offsetting arms 78, each of which has an elongate arm body parallel to the bar 37 and a shorter angularly directed mounting leg 79 having attachment ears 80 secured to the respective head bar 52 as by means of cap screws 81. The arms 78 are desirably of a length to extend in respectively opposite cross-machine directions from anchorage to the respective head bars 52 for supporting in desired starting position each of the respective slitting devices which are attached to the distal end portions of the arms by means of cap screws 65*a*. Thus, the arms 78 which supports the slitting device 32 is offset toward the upstream or backside of the supporting beam 37, is attached at its base end to the head bar 52 associated with the actuator extending toward the front side of the web W as viewed in FIGS. *3a–3d* and toward the left as viewed in FIGS. 2, 6 and 7, and supports the slitting device 32 at the opposite side of the web center line in the starting position. The arm 78 carrying the slitting device 33 is offset toward the downstream side of the supporting beam 37 and is attached at its base end to the headbar 52 associated with the actuator 53 directed toward the back of the web as viewed in FIG. *3a* and toward the right as seen in FIGS. 2, 6 and 7, with the slitting device 33 located in starting position offset toward the opposite side of the center line of the web from the slitting device 32. As a result, after the slitting devices have been lowered into slitting relation to the web W at the starting points 34, operation of the actuators 53 causes the slitting devices to traverse in respective opposite directions past one another and continuing until the slits 35 have been completed and the starting tongue area 31 is severed from the web to complete the fresh starting end 30. At termination of the slitting operation, the slitting devices 32 and 33 will have, as best seen in FIG. *3d*, pass beyond the respective opposite edges of the travelling web W. From this slit end position, the slitting devices are returned to the starting position for another slitting cycle.

Where, as shown, the web W travels in an upwardly slanting, downstream travelling direction from the guide roller 13 to the winding roll 14, the operating mode of the slitters 32 and 33 will be, as shown in FIGS. 1 and 5, tilted upwardly and in downstream direction relative to the path of travel of the web W. At the start of the operating mode, the slitting blades 59 should be disposed with their respective planes as nearly as practicable in straight line parallel relation to the longitudinal axis of the travelling web W at the starting points 34. On the other hand, for cutting the diagonal slits 35, the blades must assume the diagonal, divergent slitting directions for these slits. This is implemented by the swivel mounting of the blade holder 61, and the generally segmentally shaped clearance area of the clearance aperture 62 in the shoe 63 in each instance to accommodate the oscilation swinging of each of the respective slitting blades 62.

Since each of the blade holders 61 is free swivelling, counterbalance means are provided thereon for normally maintaining a straight ahead position of the associated blade 59. Since in operation of the slitting devices 32 and 33 they are tilted upwardly and forwardly, counterbalancing is easily accomplished by an upstreamly directed counterweight tail 82 carrying a counterbalance adjustment screw 83. Thereby the blade 59 in each instance is normally oriented straight on, but the blades 59 are adapted by virtue of their swivel mounting to assume automatically the angular relation for the slits 35 as the slitting devices are caused to traverse in cross-machine direction during the slitting operation.

Inasmuch as the starter tongue area 31 is separated from the web starting at the tip of the tongue area, means are provided for assuring that the tongue area remains substantially in the plane of the web as the tongue area lengthens and until the tongue area passes through the nip N and is deflected from the plane of the web and is turned up onto the fresh core 17. For this purpose, guide means are provided in the form of an air shower tube 83 (FIGS. 1, 2 & 8) projecting rigidly from the downstream side of the beam 37 and provided with an air shower head 84 from which air is showered downwardly onto the web W as it travels on the winding roll 14 upstream from the nip N. This assures that the advancing starter tongue area 31 will hug the winding roll 14 to the nip N. Baffle means 85 extending from the shower head 84 generally toward the nip N deflects air downstream from the shower head 84 toward the advancing tongue area 31 to assure that the tongue area will continue hugging the winding roll 14 to the nip N.

Means for controlling sequence of the roll starting system described herein may comprise manually operated devices. However, modern technology, and high production speeds demand as nearly as practicable automatic controls such as an electro-pneumatic control system on the order of that schematically illustrated in FIG. 8, wherein the customary electrical wiring and gadgetry such as wires, relays, electrical switches, etc. not specifically referred to in the system, are represented by a controller box 87. When winding the first roll R, the system may be manually controlled to initiate operation of the system. Thereafter, sequential functioning of the system should continue uninterruptedly and automatically for the duration of continuous run of the web from supply source, such as a paper making machine. Automatic controls for the system may include a finished roll diameter sensor, such as an electric eye or switch 88 for transmitting a starting signal to the controller 87. Upon such signal, the controller may, through a signal line 89, activate the fresh reel core apparatus including the arm 18 (FIG. 1) for supplying a fresh core 17 to the winding drum 14. In timed relation to that function, the controller 87 may cause a solenoid valve 90 to control delivery of air supply to the pneumatic actuator to activate the actuator for swinging the guide member arm 20 downwardly from its inactive position for positioning the web guide 18 over the fresh core 17 now on the winding drum 14. Air under pressure is supplied from a mill source 91 through suitable piping or air ducts as shown.

As the arm 20 comes to a stop in its operating position, a sensor such as a switch 92 is actuated to signal the controller 87 that the slitting phase should start. A solenoid valve 93 is then activated for reversing the controlling actuators 47 from a normal beam raising mode for the beam 37 into a beam lowering mode to swing the beam 37 down to web slitting position. At this time the slitting assemblies 32 and 33 are in the proper starting position at the inner ends of the rodless cylinder actuators 53 and sensing means comprising proximatey switches 94 so inform the controller 87. As the beam 37 reaches its lowered, operating position, a sensor, e.g., proximaty switch 96, sends a signal to the controller 87, so that low pressure air through a control valve 95, solenoid valves 97, and traverse control solenoid valves 98, continues to be delivered to the outer ends of the actuators 53 to maintain the slitting devices 32 and 33 in their starting position for a time interval necessary for starting cutting of the slits 35. Further, in timed sequence, a solenoid valve 99 is operated to deliver pneumatic line pressure to the shower head 84. Immediately after start of slitting, the solenoid valves 98 return to disconnect phase, and the solenoid valves 107 are operated to effect connection with high pressure valve 100 through solenoid control valves 101 to deliver high pressure air to the inner ends of the actuators 53 for effecting rapid traverse of the slitting devices 32 and 33 toward the outer ends of the actuators 53 for cutting the slits 35 in the web W. Sensors such as limit switches 102 advise controller 87 that the slitting devices 32 and 33 have traversed beyond the edges of the web W, whereupon the solenoid valve 93 is reversed and the slitting device beam 37 is raised away from the travelling web W.

In the meantime, the controller 87 has caused a solenoid valve 103 to open high pressure air supply to the air pipe 27 for issuing the turn-up jet 29 from the nozzle 28, thereby turning up the fresh leading end 30 of the web W.

As the slitting device beam 37 is raised, high pressure air from the valve 100 is disconnected and low pressure air through the valve 95 is resumed to return the slitting devices 32 and 33 to starting position.

After the new roll has been wound to a limited diameter on the fresh core 17, a sensor such as a limit switch 104, which may be carried by one of the arms 18 and has a control finger 105 responsive to the position of the shaft 107 of the core 17, signals and causes the controller 87 to effect reversal of the actuator 22. This causes raising of the arm 20 to clear the guide 27 and the nozzle 28 from the newly forming roll which is then moved to the position of the preceeding completed roll R that has by this time been moved into clearance relation away from the winding drum 14. The fresh roll starting system then remains quiescent until the new roll R reaches desired diameter and the sensor 88 initiates another cycle of operation of the system through the controller 87.

It will be understood that variations and modifications may be effected without departing from the spirit and scope of the novel concepts of this invention.

I claim as my invention:

1. In apparatus for winding web running continuously in a machine direction into successive rolls, and including means for starting winding of a respective leading end of the web onto a respective fresh rotating core for each successive roll while maintaining continuous running velocity of the web and continuous winding velocity of the immediately preceeding roll to completion of the winding thereof:

slitting means located upstream from said fresh rotating core and said immediately preceeding roll;

means for operating said slitting means, after a preceeding roll has been wound to a desired diameter, for starting a fresh leading end on the upstream length of the continuously running web by slitting the web, while still attached to the downstream length of the web which is being wound onto said preceeding roll, in a generally oblique cross-machine direction from the tip of a leading starter tongue projection extending downstream toward said fresh rotating core, and for thereby progressively separating the fresh leading end from the length of web wound on said preceeding roll;

said winding starting means being adapted for directing said starter tongue projection, after said tip reaches said core, with said fresh leading end into winding relation onto the fresh rotating core for winding of the upstream length of the web into another roll;

and said slitting means being coordinated to complete severing of said downstream length of the web from said leading end after winding of said starting tongue projection is started on said fresh rotating core.

2. Apparatus according to claim 1, including means for moving said slitting means into and out of slitting position relative to the running web and for guiding said slitting means in a pair of crossing arcuate slit paths and from start to finish of the slitting operation of the slitting means.

3. Apparatus according to claim 2, wherein saidh moving means comprises a structure extending in cross-machine direction relative to the running web and supporting said slitting means, said means for operating said slitting means being supported by said structure, and means for raising and lowering said structure relative to the web.

4. Apparatus according to claim 1, including electropneumatic means for controlling and coordinating operation of said slitting means and said winding starting means.

5. Apparatus according to claim 1, wherein said slitting means comprise a pair of slitting devices, and means associated with said operating means for guiding said devices for traverse from respective opposite sides of the longitudinal center line of the running web for effecting crossing generally diagonally extending slits in cross-machine direction in said web.

6. Apparatus according to claim 5, wherein said operating means comprise respective actuating means for said slitting devices, supporting means for said actuating means, and respective extension means connecting said slitting devices to the respective actuating means and with the slitting devices disposed in relative offset relation to one another, both in machine direction and in relation to the longitudinal center line of the web.

7. A method of winding into successive rolls a web running continuously in a machine direction, and including, for each successive roll, starting winding of a respective leading end of an upstream length of the web onto a respective fresh rotating core for each successive roll while maintaining continuous running velocity of the web and continuous winding velocity of the immediately preceeding roll to completion of the winding thereof, comprising:

at a location upstream from the fresh rotating core, and after the preceeding roll has reached a desired diameter, starting a fresh leading end on the upstream length of the web, while still attached to the downstream length of the web which is still being continuously wound into said preceeding roll, by slitting the continuously running web in a generally oblique cross-machine direction from the tip of a leading starter tongue projection extending downstream toward said fresh rotating core;

then after said tip reaches said core separating said fresh leading end from the length of web wound on said preceeding roll and directing said starter tongue projection with said fresh leading end of the web into winding relation to the fresh rotating core for winding of the web into another roll while said upstream end of the web is still attached to said downstream length;

and concurrently with winding of said starter tongue projection completing slitting separation of the downstream length of the web and concluding winding of said immediately preceeding roll while winding of a new roll on the fresh rotating core proceeds without interruption.

8. A method according to claim 7, comprising effecting said slitting by operation of slitting means, moving said slitting means into and out of slitting relation to the web in timed relation to winding of each roll, and guiding said slitting means in a pair of crossing arcuate slitting paths extending from start to finish of the slitting operation of the slitting means.

9. A method according to claim 7, comprising directing said starter tongue projection with said fresh leading end of the web into winding relation onto the fresh rotating core by driving an air jet toward and against said tongue projection.

10. A method according to claim 7, comprising effecting said slitting mechanically, and effecting said directing pneumatically.

11. A method according to claim 7, comprising electropneumatically controlling and coordinating operation of said starting winding, said slitting and said directing.

12. A method according to claim 7, comprising starting said fresh leading end substantially longitudinally centered on the web and effecting said slitting along crossing generally oblique cross-machine directions.

13. A method according to claim 12, comprising maintaining continuity of travel of the web upstream and downstream from the slitting until said starter tongue projection has been directed into winding relation along said fresh rotating core.

14. A method according to claim 12, which comprises gripping said starter tongue projection in the nip of a winding drum and said fresh rotating core in advance of said directing, and maintaining continuity of travel of the downstream and upstream parts of the web relative to said slitting by continuity of the web along opposite sides of the web until said tongue projection has been firmly gripped in said nip.

15. In apparatus for winding web running continuously in a machine direction into successive rolls, and including means for starting winding of a respective leading end of the web onto a respective fresh rotating core for each roll:

slitting means located upstream from said fresh rotating core;

means for operating said slitting means, after a preceeding roll has been wound to a desired diameter, for starting a fresh leading end on the continuously running web by slitting the web in a generally cross-machine direction from a leading starter tongue projection extending downstream, and for thereby separating the fresh leading end from the length of web wound on said preceeding roll;

said winding starting means being adapted for directing said starter tongue projection with said fresh leading end into winding relation onto the fresh rotating core for winding of the web into another roll;

said slitting means comprising a pair of slitting devices;

and means associated with said operating means for guiding said devices for traverse from respective opposite sides of the longitudinal center line of the running web for effecting cross generally diagonally extending slits in cross-machine direction in said web.

16. Apparatus according to claim 15, wherein said operating means comprise respective actuating means for said slitting devices, supporting means for said actuating means, and respective extension means connecting said slitting devices to the respective actuating means and with the slitting devices disposed in relative offset relation to one another, both in machine direction and in relation to the longitudinal center line of the web.

17. A method of winding into successive rolls a web running continuously in a machine direction, and including, for each roll, starting winding of a respective leading end of the web onto a respective fresh rotating core, comprising:

at a location upstream from the fresh rotating core, and after a preceeding roll has reached a desired diameter, starting a fresh leading end on the web by slitting the continuously running web in a generally cross-machine direction from a fully separated tip of a leading starter tongue projection extending downstream toward the core;

then after said separated starter tongue projection has reached the core with said fresh leading end of the web, directing the projection and leading end of the web into winding relation onto the fresh rotating core for winding of the web into another roll by driving an air jet toward and against said tongue projection.

18. A method of winding into successive rolls a web running continuously in a machine direction, and including, for each roll, starting winding of a respective leading end of the web onto a respective fresh rotating core, comprising:

at a location upstream from the fresh rotating core, and after a preceeding roll has reached a desired diameter, starting a fresh leading end on the web substantially longitudinally centered on the web by slitting the continuously running web along crossing generally oblique cross-machine directions from a leading starter tongue projection extending downstream, and thereby separating the fresh leading end from the length of web wound on said preceeding roll;

then directing said starter tongue projection with said fresh leading end of the web into winding relation onto the fresh rotating core for winding of the web into another roll.

19. A method according to claim 18, comprising maintaining continuity of travel of the web upstream and downstream from the slitting until said starter tongue projection has been directed into winding relation along said fresh rotating core.

20. A method according to claim 18, which comprises gripping said starter tongue projection in the nip of a winding drum and said fresh rotating core in advance of said directing, and maintaining continuity of travel of the downstream and upstream parts of the web relative to said slitting by continuity of the web along opposite sides of the web until said tongue projection has been firmly gripped in said nip.

* * * * *